US006299344B1

(12) United States Patent
Tannenbaum

(10) Patent No.: US 6,299,344 B1
(45) Date of Patent: Oct. 9, 2001

(54) FLEXIBLE BAND RECIPROCATING SHAKER

(75) Inventor: Myron Tannenbaum, Monroe Township, NJ (US)

(73) Assignee: New Brunswick Scientific Company, Edison, NJ (US)

( * ) Notice: Subject to any disclaimer, the term of this patent is extended or adjusted under 35 U.S.C. 154(b) by 0 days.

(21) Appl. No.: 09/787,266

(22) PCT Filed: Oct. 5, 1998

(86) PCT No.: PCT/US98/20859

§ 371 Date: Mar. 15, 2001

§ 102(e) Date: Mar. 15, 2001

(87) PCT Pub. No.: WO00/20110

PCT Pub. Date: Apr. 13, 2000

(51) Int. Cl.[7] ..... B01F 11/00
(52) U.S. Cl. ..... 366/212; 366/208
(58) Field of Search ..... 366/110–112, 114, 366/128, 208–216, 219

(56) References Cited

U.S. PATENT DOCUMENTS 1,501,625 * 7/1924 Saffert .
3,539,156 * 11/1970 Zipperer et al. .
4,125,335 * 11/1978 Blume et al. .
4,147,516 * 4/1979 De Bruyne .
4,183,677 * 1/1980 De Bruyne .
4,619,532 * 10/1986 Schmidt, III .
4,702,610 * 10/1987 Reynolds, Jr. .
5,593,228 * 1/1997 Tannenbaum .
5,655,836 * 8/1997 Preston et al. .
5,934,804 * 8/1999 Branson et al. .
5,988,869 * 11/1999 Davidson et al. .

* cited by examiner

*Primary Examiner*—Charles E. Cooley
(74) *Attorney, Agent, or Firm*—Woodbridge & Associates, P.C.; Richard C. Woodbridge

(57) ABSTRACT

A reciprocating laboratory shaker (10) includes a platform (12) driven by a motor (62) which is constrained to move in a reciprocating fashion by a pair of flexible bands (30, 32) located on opposite sides of the platform (12). A frame (24), which preferably supports the drive motor (62), includes a pair of upright supports (28) which are attached to a pair of wide, but thin, flexible plastic bands (30, 32) at least at two locations. Each of the two flexible bands (30, 32) includes a pair of rollers (34, 36, 38, 40) attached to the inside surface (50) of the bands (30, 32). The laboratory platform (12) is attached to the remaining outside face (52) of the bands and is driven by the drive motor (62) having an appropriate crank mechanism (54). The two flexible bands (30, 32) constrain the motion of the platform (12) to substantially a single direction, x, while preventing it from moving in either the y or z directions.

7 Claims, 8 Drawing Sheets

FLEXIBLE BAND RECIPROCATING SHAKER

BACKGROUND OF THE INVENTION

1. Field of the Invention

The invention relates to a laboratory shaker drive mechanism including a pair of flexible bands which restrain the movement of the shaker platform to a single dimension.

2. Description of Related Art

Laboratory shakers, and the like, are known in the prior art. See, for example, U.S. Pat. No. 5,593,228 issued on Jan. 14, 1997 and entitled "ROTARY SHAKER WITH FLEXIBLE STRAP SUSPENSION." The inventor is Myron Tannenbaum, Cranbury, N.J., and the patent is assigned to New Brunswick Scientific Co., Inc., Edison, N.J., the assignee of the present application. That patent describes a shaker which produces motion in an orbital plane and in which the shaker platform is restrained by two pairs of flexible metal straps.

Another rotary laboratory shaker is described in U.S. Pat. No. 4,183,677 issued on Jan. 15, 1980 and entitled "MECHANISM FOR EFFECTING ORBITAL MOTION OF A MEMBER". The inventor is Norman A. De Bruyne, Princeton, N.J. That disclosure also describes the use of flexible members to constrain the motion of a laboratory shaker platform to an orbital circuit.

Devices other than laboratory shakers also include flexible or reciprocating motion drivers. See, for example, U.S. Pat. No. 1,501,625 issued on Mar. 10, 1924 to Warren Sadorus and entitled "CORN-POPPING MACHINE." That device includes a drive mechanism for constraining the motion of a corn-popping pan to a strictly single dimension.

Also of possible relevance is the disclosure in Russian Patent Application SU-588-167 entitled "LABORATORY, MULTI-BOWL FEEDER". As described in that device a pair of animal feed bowls is driven by a single shaft through two pairs of flexible straps.

While the prior art appears to describe diverse drive mechanisms including flexible drive members, nevertheless, there does not appear to be any teaching or suggestion of an inexpensive and dependable reciprocating laboratory shaker suitable for use in a laboratory environment.

It was in the context of the above prior art that the present invention arose.

SUMMARY OF THE INVENTION

Briefly described, the invention comprises a laboratory shaker which includes a platform constrained to reciprocate in a single direction by a pair of flexible straps located on opposite sides of the platform. A frame, including a pair of upright supports, also supports a drive motor. Each of the upright supports is attached to the outside surface of a flexible strap or belt. The pair of flexible belts includes two rollers located at opposite ends thereof which contact the inner surface of the flexible belts. The other outer surface, distal from the side connected to the frame supports, is connected to the reciprocating platform. The laboratory flasks, or other laboratory items, are placed on the platform. The drive motor causes the platform to move only in a single dimension restricted by the flexible belts.

These and other features of the invention will be more fully understood by reference to the following drawings.

DETAILED DESCRIPTION OF THE INVENTION

During the course of this disclosure, like numbers will be used to identify like elements according to the different figures which illustrate the invention.

Figure 1:
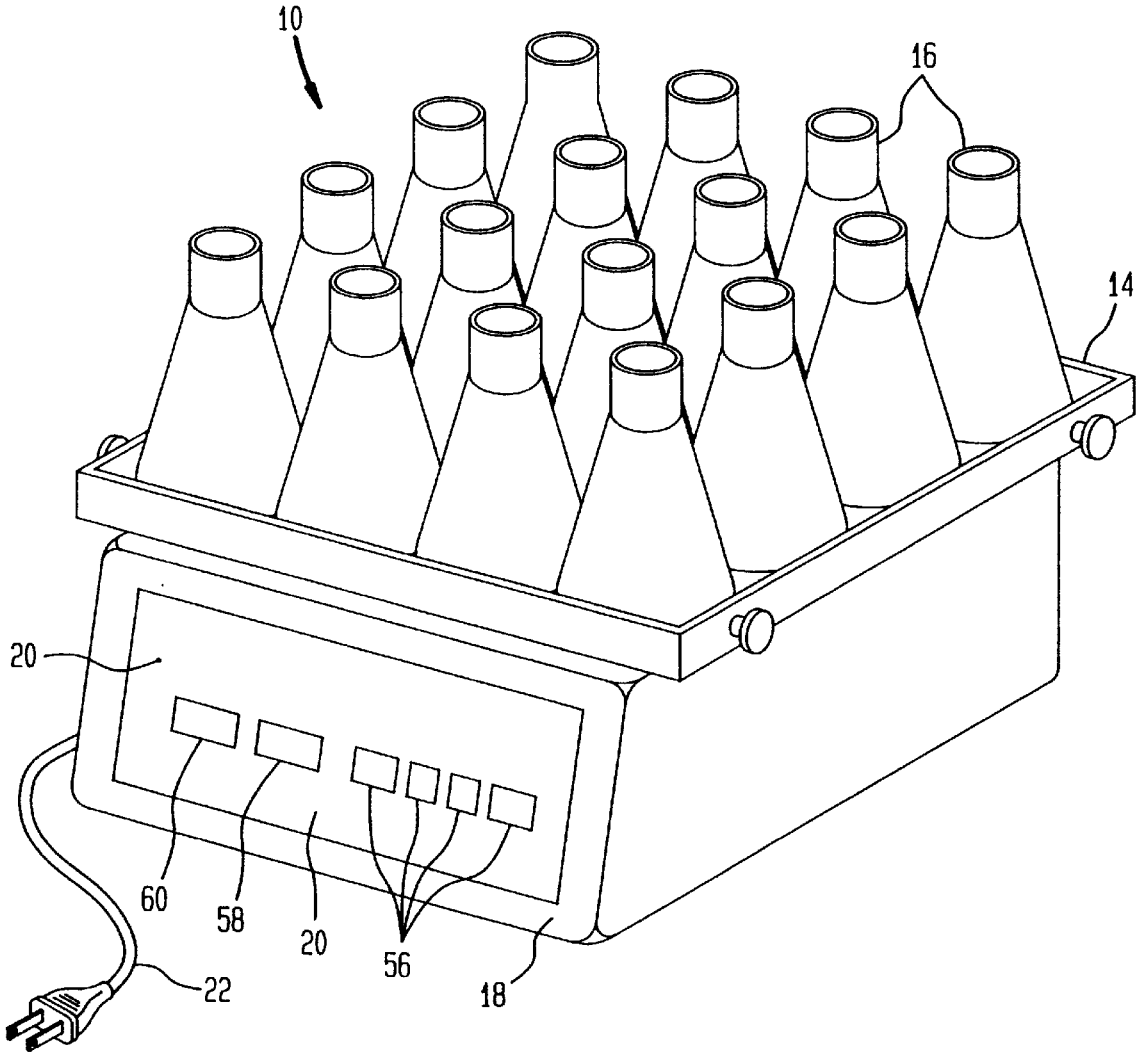
FIG. 1 is a front perspective view of the flexible band reciprocating shaker platform invention according to the preferred embodiment thereof.

The preferred embodiment of the invention 10 is illustrated in an assembled perspective view in FIG. 1. Invention 10 includes a reciprocating platform 12, that only moves in a forward and backward direction, i.e., 1 dimension, not 2 dimensions, which supports a tray 14 which in turn supports a plurality of laboratory flasks 16 or Petri dishes or the like. A chassis cover 18, or skin, surrounds the internal drive mechanism and protects it from dust and chemical spills and the like. Chassis 18 also supports a control panel 20 which may include a key pad 56 for controlling the speed, periodicity, and duration of the reciprocating shaking of the platform 12 and associated tray and flasks 16. A control panel 20 could typically include a speed indicator 58 and a time indicator 60. Power is provided to an electric drive motor 62 and the control panel 20 through a conventional electric cord 22. In many respects the outward appearance of the invention 10 is similar to that of other prior art laboratory devices.

The internal mechanism that drives the platform 12 is best understood by reference to FIGS. 2A to 5, which represent counter-respectively orthogonal views of the drive mechanism. Invention 10 is supported by a frame 24 which includes a base 26 and a pair of upright supports 28. Base 26 would also typically support the electric drive motor 62. Electric drive motor 62 is preferably connected to the underside of the platform 12 through a conventional crank mechanism 54. A number of well known crank mechanisms, previously used in the art, would be satisfactory and accordingly, the specific crank mechanism 54, illustrated in the drawings and described herein, is not intended to limit the universe of crank mechanisms potentially available for inclusion in this invention 10. A crank mechanism 52 would allow for adjustable stroke settings, but is not intended to limit the universe of crank mechanisms or other push-pull mechanisms available for inclusion in this invention. Other types of drive mechanisms might include pneumatic drive mechanisms, solenoid drive mechanisms, audio speaker electromagnetic coil mechanisms, etc.

The pair of upright supports 28 each includes an inward facing surface 64. The inward facing surfaces 64 are attached by at least two pair of attachment means, such as bolts, rivets, metal screws, etc., 42 to the outside surface 52 of flexible belts 30 and 32, respectively. The flexible belts 30 and 32 shown in the preferred embodiment of FIGS. 1–6C are two inches wide, 0.0625 inches thick and 22 inches long. Belts 30 and 32 are preferably fabricated from polyethylene or could be made from any other suitable, flexible, but not especially elastic material. While belts 30 and 32 have been described with respect to its preferred embodiment, it will be understood that belts 30 and 32 can be varied in thickness, width and length to accommodate different platform 12 loads and strokes. In addition, belts 30 and 32 can actually comprise two flexible discontinuous pieces of material rather than one single strap in view of the fact that the portions of the belts 30 and 32 between the attachment means 42 and 46 do not move. Moreover, it may be desirable to provide more than two sets of belts 30 and 32, perhaps a pair on both sides, in order to accommodate heavier platforms and loads. Rollers 34, 36, 38, and 40 as shown in FIGS. 1–6C, were made from sections of standard PVC pipe, 1 ¼ inch in diameter and 2 inches long.

Figure 2A:
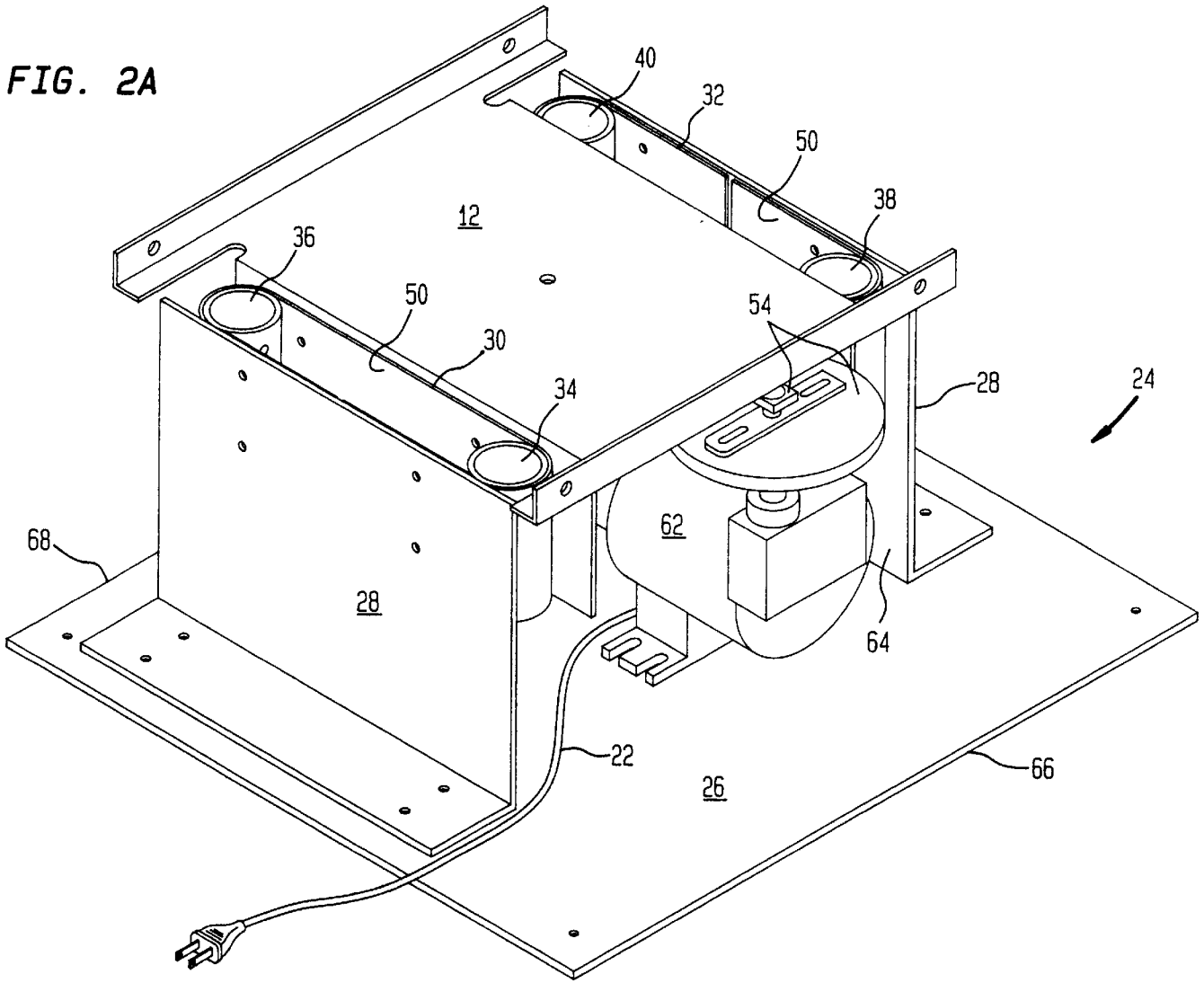
FIG. 2A is a perspective view of the flexible band reciprocating shaker platform illustrated in FIG. 1 with the chassis and flask support tray removed.
Figure 2B:
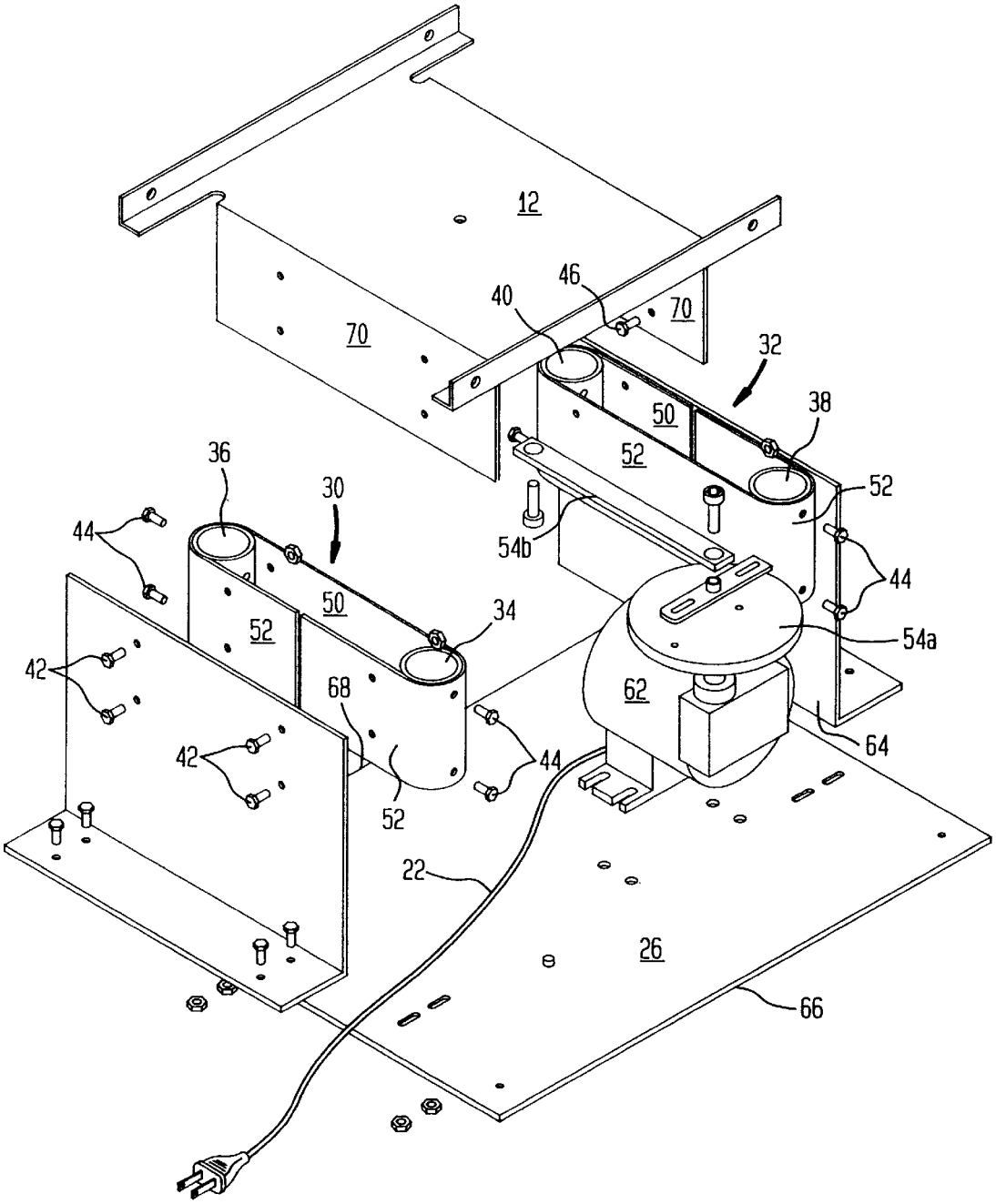
FIG. 2B is an exploded view of the flexible band reciprocating shaker platform.
Figure 5:
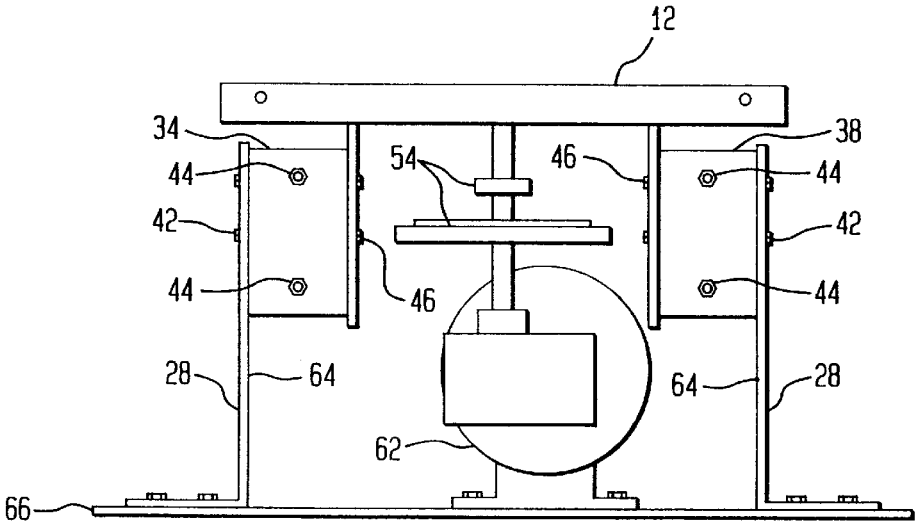
FIG. 5 is a front elevational view of the platform with the tray and chassis removed.

The first flexible belt 30 includes a pair of rollers 34 and 36 located on the inside thereof, and contacting the inside surface 50 of the first flexible belt 30. Rollers 34 and 36 respectively are attached to the first belt 30 by roller/belt attachments 44 which could comprise nails, machine screws, bolts, rivets or the like as shown in FIGS. 2B and 5. Similarly, the second flexible belt 32 includes a pair of rollers 38 and 40 located on the inside thereof and contacting the inner surface 50. Rollers 38 and 40 are attached to the second flexible belt 32 by a suitable roller/belt attachment such as wood screws, machine screws, bolts, rivets, etc. 44. Rollers 34, 36, 38, and 40 can be made of any suitable durable, nonelastic material, such as wood, metal or plastic.

Lastly, the outside surface 52 of each of the flexible belts 30 and 32, opposite the side attached to the upright supports 28, are attached to the platform 12 by a plurality of suitable support/belt attachments 46 which again, might comprise common fasteners such as wood screws, machine screws, bolts, rivets, or the like depending upon the materials employed in the platform 12 or the upright supports 28. For example, if the upright supports 28 and the platform 12 were made of wood, then wood screws would be suitable, or if the platform 12 and the upright supports 28 were made of thin gauge metal, then sheet metal screws, bolts or rivets might be suitable.

Figure 6A:
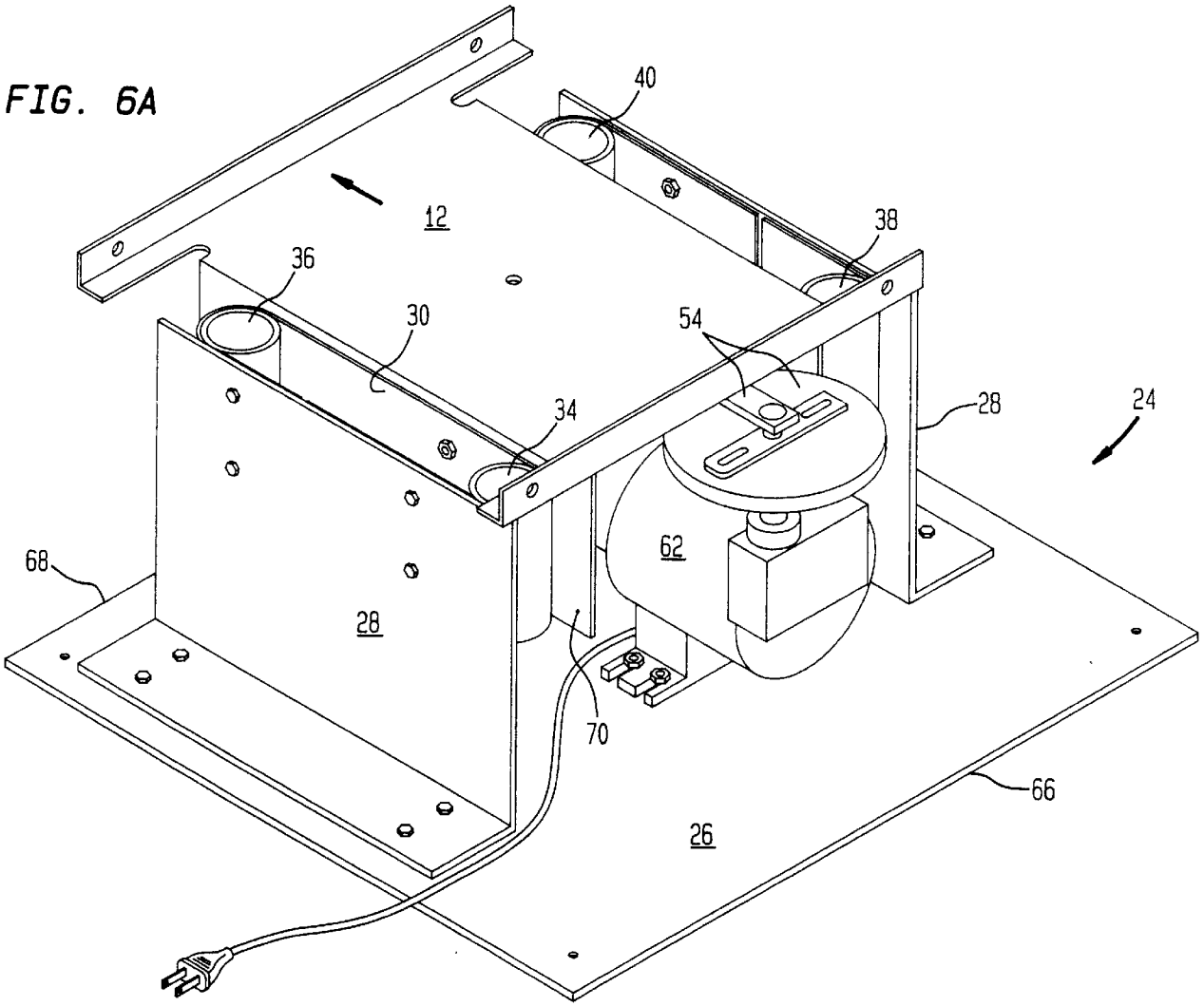
FIG. 6A illustrates the shaker platform in its fully reversed mode.
Figure 6B:
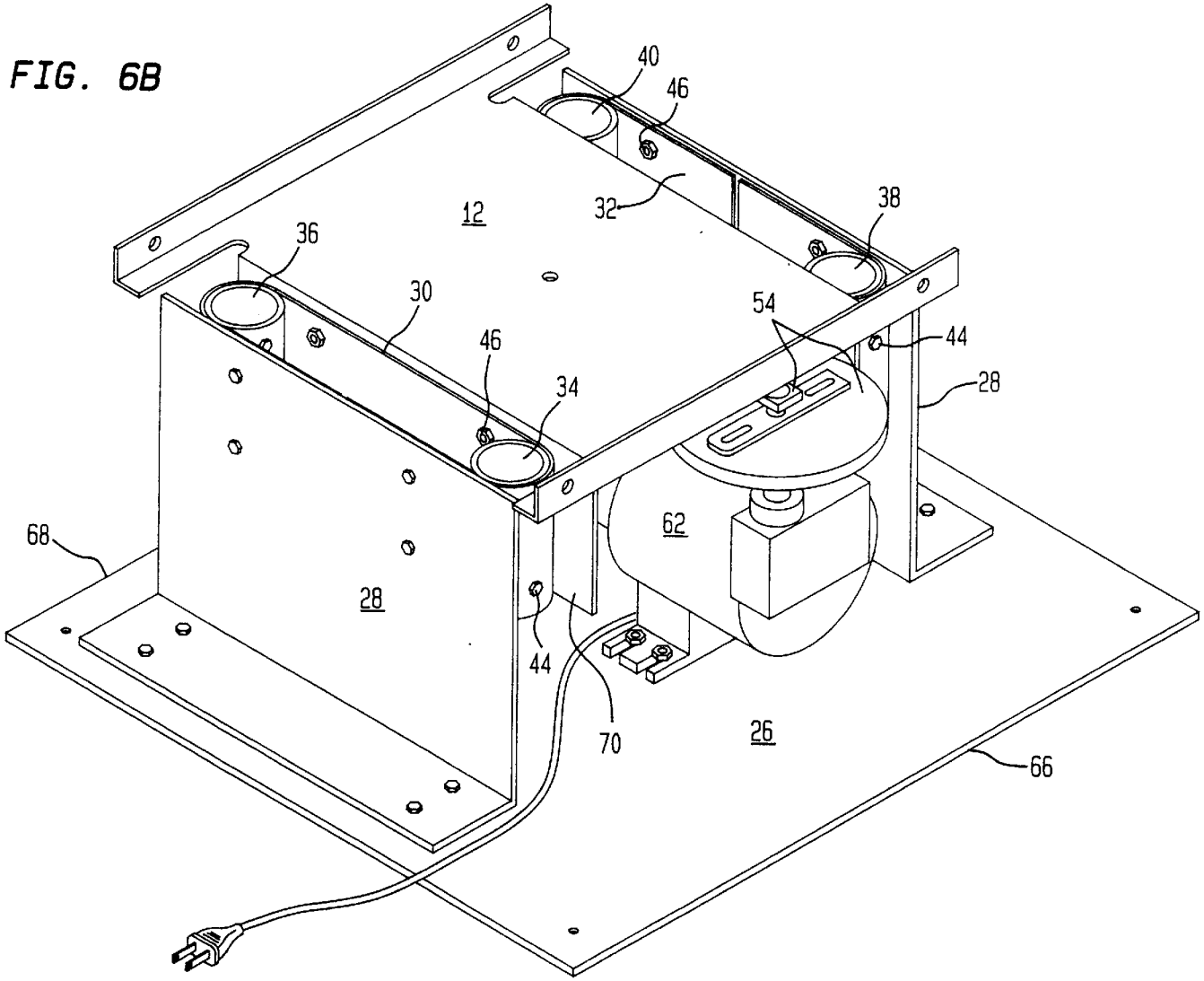
FIG. 6B illustrates the platform in its central, or neutral, position between the positions illustrated in FIG. 6A and FIG. 6C.
Figure 6C:
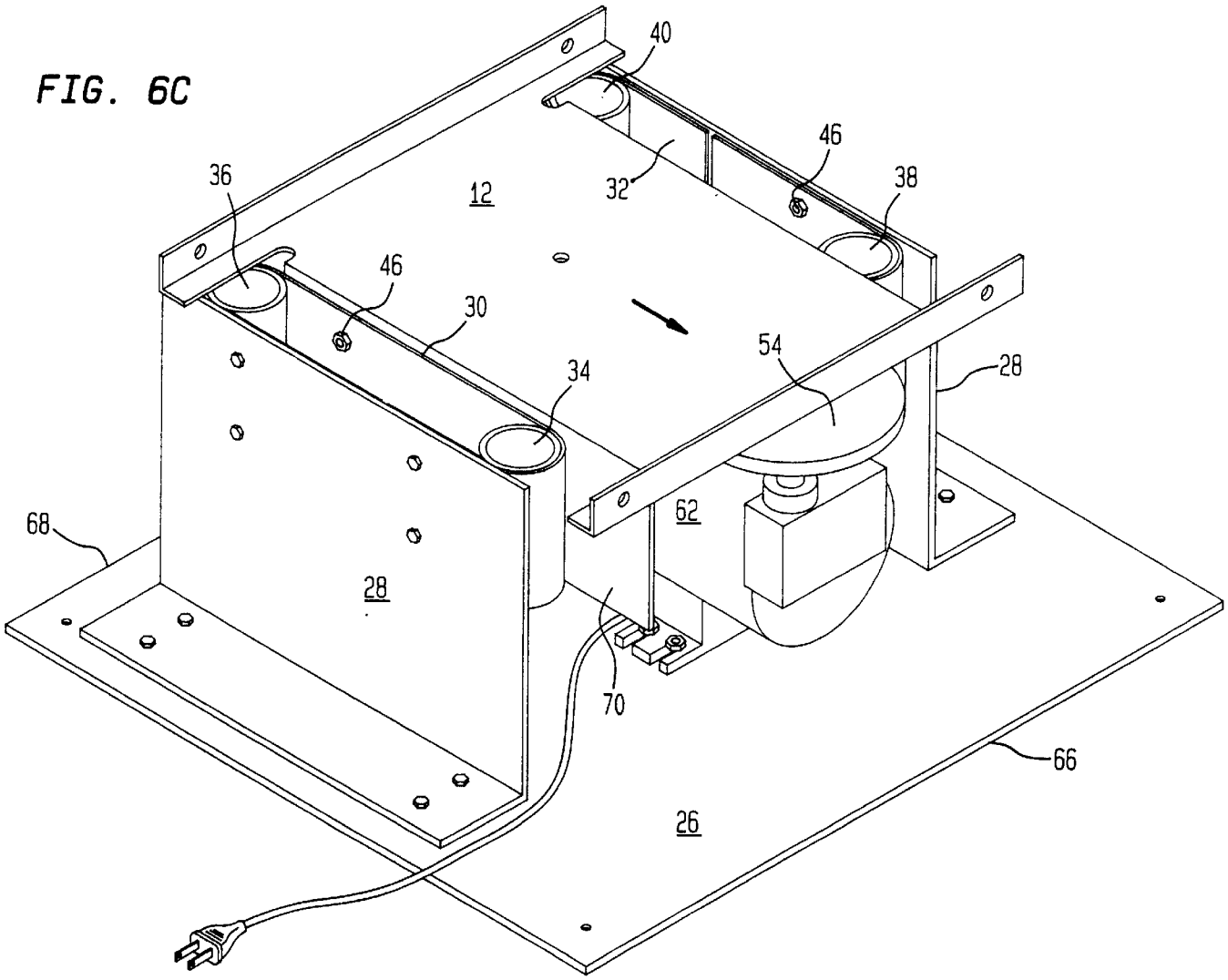
FIG. 6C illustrates the shaker platform in its fully forward mode.

The reciprocating motion of the drive mechanism is illustrated in a progressive fashion in FIGS. 6A–6C.

In FIG. 6A, the platform 12 is shown in its most withdrawn, i.e., reversed, position with the platform 12 closest to the rear 68 of the machine and farthest from the front 66 of the machine. In this position the rollers 34, 36, 38 and 40 have rotated approximately 60 degrees such that the roller/belt fastener 44 are almost adjacent to the downward facing portions 70 of the platform 12. The downward facing portions 70 of the platform 12 essentially ride on the rollers 34, 36, 38 and 40 which in turn ride against the inside surfaces of the two upright supports 28.

Figure 3:
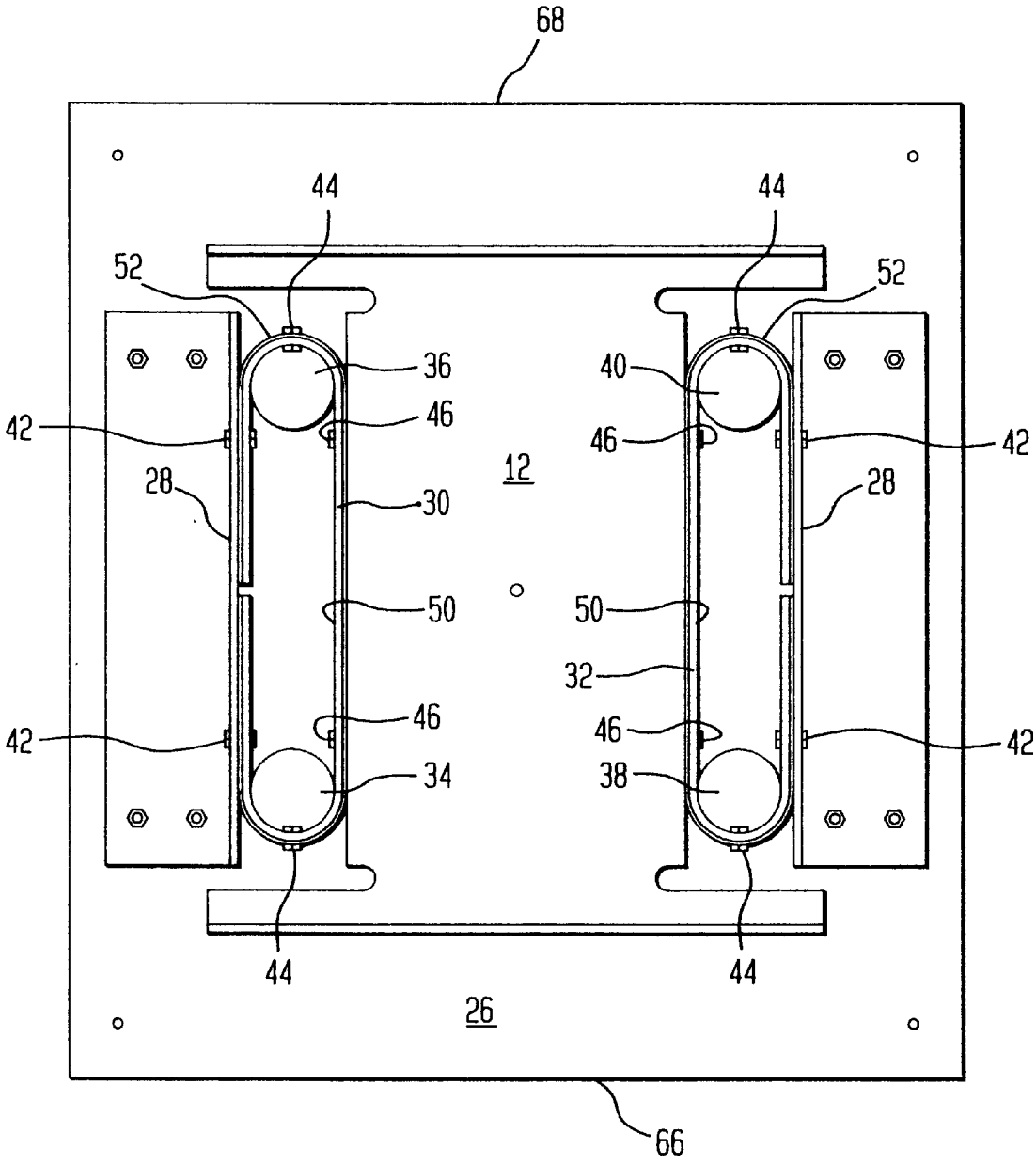
FIG. 3 is a top plan view of the shaker platform with the tray and chassis removed.
Figure 4:
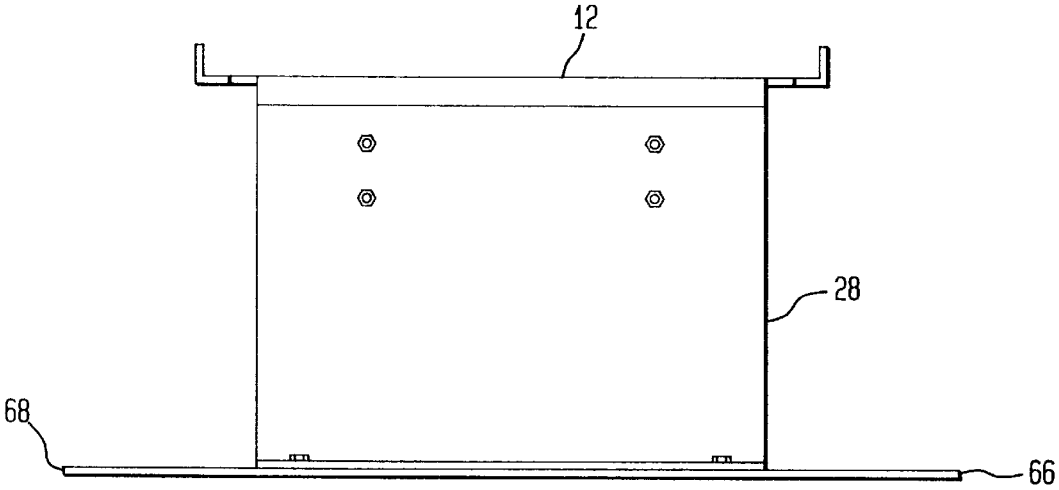
FIG. 4 is a side elevational view of the platform mechanism with the tray and chassis removed.

As the crank mechanism 54 moves forward under the influence of drive motor 62, the platform is driven towards the central, or neutral, position as illustrated in FIG. 6B. This is the same mode that is also seen in FIGS. 3–5. In this case the platform 12 is effectively equi-distance between the front 66 and back 68 of the base 26. Moreover, the roller/belt attachments 44 effectively face directly forward and backward respectively.

Finally, as seen in FIG. 6C, the crank mechanism 54 has advanced to its other extreme under the influence of drive motor 62 so that the platform 12 is closest to the front edge 66 and furthest from the back edge 68. In t his mode the rollers 34, 36, 38 and 40 have rotated approximately 60 degrees in the opposite direction from neutral as seen in FIG. 6B, so that the roller/belt attachment means 44 almost come into contact with the pair of upward supports 28.

During the t ravel from the extreme positions illustrated in FIGS. 6A and 6C, the platform 12 smoothly rotates under the influence of rollers 34, 36, 38 and 40 and the flexible belts 30 and 32. Because the rollers are effectively in contact with the upright supports 28 and the flat lower portions 70 of the platform 12 all the time, the back and forth ride of the platform is very smooth. The flexibility of the belt, given its minor elastic characteristics, further helps to dampen any irregularities in the ride.

The invention 10 just described has several advantages over the prior art.

First, be cause the plat form 12 is supported by the belts 30 and 32 and the rollers 34, 36, 38 and 40 maintain the vertical rigidity of the belts 30 and 32 throughout the total movement and the fact that the rollers 34, 36, 38 and 40 move across flat surfaces separated only by the thickness of the belts 30 and 32, the motion of the platform 12 is smooth, and not erratic. Additionally, the force required to move the platform 12 is virtually constant even though relatively increased platform 12 loads can be accommodated. Also, the full length of the platform 12 is maintained a constant horizontal plane throughout the total movement.

Second, the mechanism is very sturdy and dependable. This means that it has a long life, especially under adverse conditions.

Third, the snug fit between the belts 30 and 32 and the surrounding fixed and moving supports 28 and 70, results in a motion devoid of undesirable or extraneous vertical motion or side play.

Fourth, the mechanism 10 is nearly noise free as compared to like devices using ball or sleeve bearings. Since many of these shaker devices are used in a laboratory setting on a continuous basis, a quiet running machine such as the present invention 10 is very desirable.

Fifth, the concept of the invention is easily adapted for scaling up in size and performance. Larger shakers can be made by increasing the belt thickness a nd width. The stroke length of the larger platform can be increased by making the roller diameters larger.

Sixth, the materials, fabrication and assembly costs are relatively inexpensive. The effort and time to repair or maintain the present invention 10 is minimal based upon its simplicity. Accordingly, the system can be provided to the public at a relatively reasonable and competitive cost.

While the invention has been described with reference to the preferred embodiment thereof, it will be appreciated by those of ordinary skill in the art that modifications can be made to the structure and function of the invention 10 with out departing from the spirit and scope thereof.

I claim:

1. A drive apparatus for a shaker (10) including a drive means (54, 62), said apparatus comprising:

a frame (24);

flexible band means (30, 32) attached to said frame (24), said flexible band means (30, 32) having an inner surface (50) and an outer surface (52);

roller means (34, 36, 38, 40) for contacting said inner surface (50) of said flexible band means (30, 32); and, platform means (12) attached to said outer surface (52) of said flexible band means (30, 32) and to said drive means (54, 62), wherein said flexible band means (30, 32) restricts the motion of said platform means (12) to a substantially reciprocal motion.

2. The apparatus of claim 1 wherein said flexible band means (30, 32) comprises at least a first and a second flexible band (30, 32) attached to opposite sides of said platform means (12).

3. The apparatus of claim 2 wherein said roller means comprises a pair of roller means (34, 36) (38, 40) for contacting said inner surface (50) of said first and second flexible bands (30, 32), respectively.

4. The apparatus of claim 3 further comprising:

first attaching means (44) for attaching said first and second flexible bands (30, 32) to said pair of roller means (34, 36) (38, 40), respectively; and, second attachment means (42) for attaching said first and second flexible bands (30, 32) to said frame (24); and, third attachment means (46) for attaching said first and second flexible bands (30 32) to said platform means (12).

5. The apparatus of claim 4 wherein said first and second flexible bands (30, 32) comprise a plastic, but substantially non-elastic, material.

6. The apparatus of claim 5 wherein said apparatus comprises a laboratory shaker.

7. The apparatus of claim 6 wherein said flexible bands are split in at least one location.

* * * * *